US011209126B2

(12) United States Patent
Kennedy et al.

(10) Patent No.: US 11,209,126 B2
(45) Date of Patent: Dec. 28, 2021

(54) SYSTEM AND METHOD FOR TRANSFERRING LIQUIFIED PETROLEUM (LP) GAS

(71) Applicant: Blossman Services, Inc., Ocean Springs, MS (US)

(72) Inventors: David Alexander Kennedy, Asheville, NC (US); Jessie W. Johnson, Asheville, NC (US)

(73) Assignee: Blossman Services, Inc., Ocean Springs, MS (US)

( * ) Notice: Subject to any disclaimer, the term of this patent is extended or adjusted under 35 U.S.C. 154(b) by 23 days.

(21) Appl. No.: 16/557,636

(22) Filed: Aug. 30, 2019

(65) Prior Publication Data

US 2019/0383445 A1 Dec. 19, 2019

Related U.S. Application Data

(63) Continuation of application No. 15/220,224, filed on Jul. 26, 2016, now Pat. No. 10,400,957.

(51) Int. Cl.
*F17C 13/04* (2006.01)
*F17C 9/00* (2006.01)

(52) U.S. Cl.
CPC ..... *F17C 13/04* (2013.01); *F17C 9/00* (2013.01); *F17C 2221/035* (2013.01); *F17C 2223/0153* (2013.01); *F17C 2223/033* (2013.01); *F17C 2227/0135* (2013.01); *F17C 2260/044* (2013.01); *F17C 2260/048* (2013.01); *F17C 2270/0168* (2013.01)

(58) Field of Classification Search
CPC .... F17C 13/04; F17C 9/00; F17C 2270/0168; F17C 2260/048; F17C 2260/044
See application file for complete search history.

(56) References Cited

U.S. PATENT DOCUMENTS 2,922,288 A ‡ 1/1960 Delaney ..... B67D 7/26 222/26
3,620,658 A ‡ 11/1971 Tappin ..... F23N 5/105 138/30
3,783,888 A * 1/1974 Johnson ..... F04F 10/02 137/145

(Continued)

FOREIGN PATENT DOCUMENTS

WO WO 2016029323 ‡ 3/2016 ..... B67D 7/64
WO WO2016029323 3/2016

*Primary Examiner* — Angelisa L. Hicks
(74) *Attorney, Agent, or Firm* — Sterne, Kessler, Goldstein and Fox P.L.L.C.

(57) ABSTRACT

A system for transferring LP gas includes an inlet port configured for connection to a single connection port of a first tank. The inlet port is configured to receive liquid phase LP gas, vapor phase LP gas, or a combination of both from the first tank. An outlet port is configured for connection to a single connection port of a second tank. The outlet port is configured to deliver the liquid phase LP gas, vapor phase LP gas, or combination of both to the second tank. A pump coupled between the inlet port via a first conduit and the outlet port via a second conduit is operable to pump the liquid phase LP gas, vapor phase LP gas, or combination of both from the first tank via the inlet port to the second tank via the outlet port through the first and second conduits.

17 Claims, 3 Drawing Sheets

(56) References Cited

U.S. PATENT DOCUMENTS

| | | | | | |
|---|---|---|---|---|---|
| 3,812,888 | A * | 5/1974 | Dalton | F17C 5/02 | 141/39 |
| 4,726,203 | A ‡ | 2/1988 | Komuro | E05B 77/50 | 292/144 |
| 5,265,656 | A ‡ | 11/1993 | McGarvey | B67D 7/04 | 137/312 |
| 5,603,224 | A ‡ | 2/1997 | Scaringe | F25B 45/00 | 62/125 |
| 7,549,847 | B1 * | 6/2009 | McClatchey | F04B 9/02 | 417/15 |
| 2004/0187957 | A1 ‡ | 9/2004 | Scheeter, Jr. | F17C 7/02 | 141/86 |
| 2006/0162810 | A1 ‡ | 7/2006 | Eshenour | B67D 7/0266 | 141/285 |
| 2012/0297772 | A1 * | 11/2012 | McBride | F01K 25/06 | 60/649 |
| 2013/0087227 | A1 ‡ | 4/2013 | Metz | B67D 7/02 | 137/565.01 |
| 2016/0032783 | A1 * | 2/2016 | Howes | F01K 3/006 | 60/650 |
| 2016/0131132 | A1 * | 5/2016 | Stockner | F04B 53/143 | 277/436 |
| 2016/0154410 | A1 * | 6/2016 | Armitage | B67D 7/362 | 137/2 |

* cited by examiner
‡ imported from a related application

SYSTEM AND METHOD FOR TRANSFERRING LIQUIFIED PETROLEUM (LP) GAS

CROSS-REFERENCE TO RELATED APPLICATION

This application is a continuation of U.S. application Ser. No. 15/220,224, filed Jul. 26, 2016, which is hereby incorporated herein in its entirety by reference.

BACKGROUND

Field

The disclosure relates to a system and method for evacuating liquefied petroleum (LP) gas from a vehicle fuel tank to a storage tank.

Background

LP gas is a by-product of natural gas processing and includes such fuels as propane and butane, and may also include amounts of propylene and butylene in various mixtures. As used herein, the terms "liquefied petroleum gas," "LP gas," and "LPG" are used interchangeably and are intended to refer to propane, butane, iso-butane, propylene, butylene, and methane, alone or in various mixtures, as well as to mixtures of other hydrocarbon gases that are stored in liquid form, under pressure, and are used as fuel for internal combustion engines.

LP gas is highly flammable and is commonly used for fueling cooking and heating appliances. LP gas is also increasingly being used to power personal and commercial vehicles.

At normal atmospheric temperatures and pressures, LP gas is in a gas phase, but LP gas is in a liquid phase when stored under pressure, such as in a vehicle fuel tank. A partially filled vehicle fuel tank will typically contain some LP gas in a liquid phase as well as some LP gas in a gas phase. When it is necessary to repair or replace the fuel tank or a part in, or coupled to, the tank, the tank must be emptied to reduce fire or explosion hazard. Conventionally, when a vehicle fuel tank filled with an LP gas needs to be emptied, it is done manually by opening an 80% fixed liquid level gauge (also known as the 80% bleed valve) on the fuel tank to bleed the LP gas from the vehicle's tank into the atmosphere. This method is slow and dangerous, as it poses a fire or explosion risk. This method also wastes significant amounts of LP gas. Further, gas-phase LP gas tends to remain in the fuel tank, even after draining. It is for this reason that the manual bleed process is also referred to as an "80% bleed."

While turbine pumps are used in the LP gas industry to extract liquid-phase LP gas from rail cars and other large tanks, such pumps are not used to remove LP gas from vehicle fuel tanks. This is due to flow rate limitations of the vehicle fuel tanks. In the U.S. and some other countries, governmental regulations require that LP gas fuel tanks include an excess flow valve to prevent an excess flow of LP gas from the tank in the event of a major leak in the downstream routing of the LP gas. The excess flow valve is installed in the liquid service supply valve in the fuel tank before the fuel line. When a flow rate of fuel leaving the tank exceeds a predetermined flow rate (e.g., 1.4-2.0 gallons per minute or gpm), the excess flow valve closes to stop fuel flow. It will then stay closed until pressure on each side of the value is equalized. This flow rate restriction makes emptying the tank via the valve to be slow and difficult, because turbine pumps tend to have significantly higher flow rates than that permitted by the liquid supply service valve's excess flow valve. Thus, when use of a turbine pump is attempted, the excess flow value will be tripped, preventing flow until reset. Moreover, such turbine pumps used in the LP gas industry can remove liquid-phase LP gas but will not evacuate gas-phase LP gas, and can be damaged when attempting to do so.

Further, turbine pumps tend to generate excessive heat while pumping which causes the liquid LP gas to convert into vapor, making such pumps work less efficiently, potentially leading to pump damage and explosion risk due to overheating. As an example, LP gas has a boiling point of −43.6° Fahrenheit, and LP gas is affected by changes in heat or pressure. In this case, rapid displacement of the liquid-phase LP gas can cause the liquid to quickly vaporize. And the high speeds of these pumps causes both excessive heat in a chamber of the pumps and rapid displacement which in turn causes the liquid to expand even more quickly and vaporize.

What is needed is a method for emptying the vehicle fuel tank of both liquid LP gas as well as gas-phase LP gas in an environmentally-responsible, time-efficient, and safe manner, and for capturing and storing the removed LP gas for later refilling of the vehicle fuel tank or for other use.

BRIEF DESCRIPTION OF THE DRAWINGS

The accompanying drawings, which are incorporated herein and form a part of the specification, illustrate embodiments of the present disclosure and, together with the description, further serve to explain the principles of the disclosure and to enable a person skilled in the pertinent art to make and use the embodiments.

Figure 1:
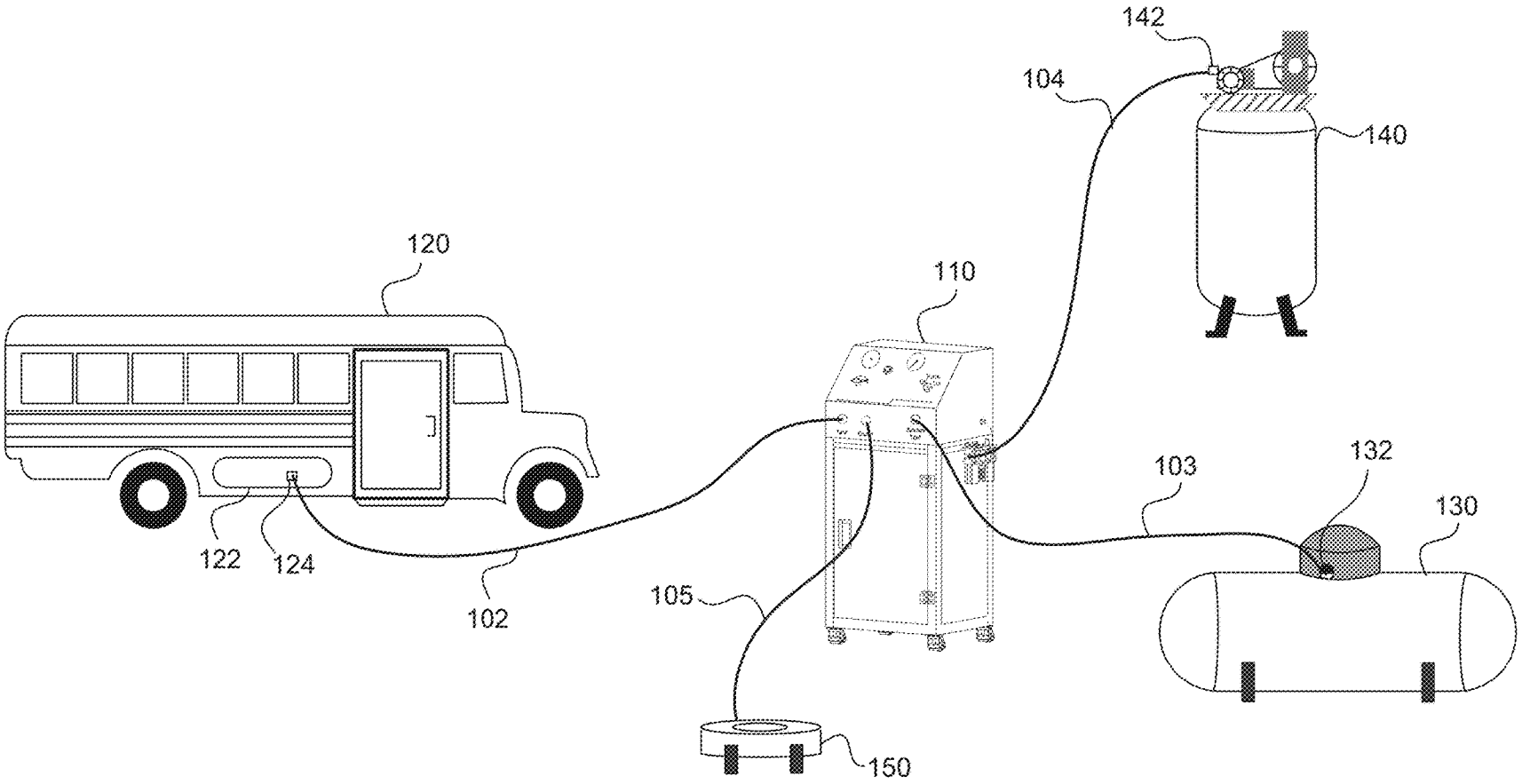
FIG. 1 illustrates an evacuation system connected between a vehicle, a storage tank, a burner, and an air compressor, according to exemplary embodiments of the present disclosure.

The present disclosure will be described with reference to the accompanying drawings. In the drawings, like reference numbers indicate identical or functionally similar elements. Additionally, the left most digit(s) of a reference number identifies the drawing in which the reference number first appears.

DETAILED DESCRIPTION

The following Detailed Description refers to accompanying drawings to illustrate exemplary embodiments consistent with the disclosure. References in the Detailed Description to "one exemplary embodiment," "an exemplary embodiment," "an example exemplary embodiment," etc., indicate that the exemplary embodiment described may include a particular feature, structure, or characteristic, but every exemplary embodiment may not necessarily include the particular feature, structure, or characteristic. Moreover, such phrases are not necessarily referring to the same exemplary embodiment. Further, when a particular feature, structure, or characteristic is described in connection with an exemplary embodiment, it is within the knowledge of those skilled in the relevant art(s) to affect such feature, structure, or characteristic in connection with other exemplary embodiments whether or not explicitly described.

The following Detailed Description of the exemplary embodiments reveal the general nature of the invention so that others can, by applying knowledge of those skilled in the relevant art(s), readily modify and/or adapt for various applications such exemplary embodiments, without undue experimentation, without departing from the spirit and scope of the disclosure. Therefore, such adaptations and modifications are intended to be within the meaning and plurality of equivalents of the exemplary embodiments based upon the teaching and guidance presented herein. It is to be understood that the phraseology or terminology herein is for the purpose of description and is to be interpreted by those skilled in relevant art(s) in light of the teachings herein.

The present disclosure presents an LP gas evacuation system and method for evacuating LP gas from a vehicle fuel tank that overcomes the limitation of known systems and methods. The disclosed LP gas evacuation system includes an inlet port that connects to an excess flow valve associated with the vehicle fuel tank to receive LP gas from the vehicle fuel tank, an outlet port that connects to a storage tank, and a pump coupled between the inlet port and the outlet port. The pump is operable to pump the LP gas from the vehicle fuel tank via the inlet port to the storage tank via the outlet port. The pump is a pneumatically driven displacement pump that has seals formed from a material substantially resistant to degradation by contact with the LP gas. The LP gas evacuation system further includes a pneumatic pressure regulator configured and arranged to receive a supply of compressed air that is provided to the pump at a desired pressure, and a housing to hold the pump and the pneumatic pressure regulator. The housing has a control panel including a switch to selectively supply the compressed air to the pump, pressure gauges to display LP gas pressure at the inlet port and the outlet port, and a sight glass coupled between the pump and the outlet port to permit visual inspection of the LP gas (in either liquid phase or gas phase) being transferred by the pump.

FIG. 1 is a block diagram illustrating an evacuation system 110, according to exemplary embodiments of the present disclosure, connected to a vehicle 120, a storage tank 130, an air compressor 140, and a burner 150 via hoses 102-105. The plurality of hoses 102-105 are configured to connect evacuation system 110 to vehicle 120, storage tank 130, air compressor 140, and burner 150, respectively. Hoses 102, 103 and 105 are conduits formed from materials that are substantially resistant to degradation by contact with an LP gas, and have sufficient structural integrity to withstand the vapor pressures found in a vehicle propane tank (e.g., 300 psi). Additionally, hose 102 should have sufficient structural integrity to withstand a vacuum pressure of zero psi exerted by pump 210 (shown in FIG. 2 and described below). In an exemplary embodiment, hoses 102, 103 and 105 can be formed from metals such as copper, brass or steel, or some polymers such as polyethylene or nitrile, or combinations of these material. But flexibility is desired in hoses 102, 103 and 105 for many applications, so rigid metal pipes would not be a desired embodiment for all applications. Examples of flexible hoses suitable for hoses 102, 103, and 105 include a synthetic rubber hose, such as an Aeroquip FC-321 PG hose (available from Aeroquip Performance Products, http://aeroquipperformance.com, a subsidiary of Eaton Corporation PLC, Cleveland, Ohio) or a series 7132 LPG hose manufactured by Parker Hannifin Corporation, Parflex Division, Ravenna, Ohio, http://parker.com. Hose 104 is a conduit formed from any material suitable for use with compressed air that can withstand working air pressures of, for example, 150 psi. In an exemplary embodiment, hoses 102-105 (or portions of the hoses) are sufficiently flexible to facilitate making connections between the components shown in FIG. 1.

Evacuation system 110 is configured to remove LP gas from vehicle 120. Vehicle 120 may be any vehicle adapted to operate on LP gas and has a fuel tank 122 configured to hold LP gas. Fuel tank 122 includes an excess flow valve 124 configured to close off when a flow rate of fuel exiting excess flow valve 124 exceeds a predetermined flow rate (e.g., 1.4-2.0 gpm). Evacuation system 110 is configured for attachment to excess flow valve 124 by way of the connection tube 102.

Evacuation system 110 is configured to pump LP gas from vehicle fuel tank 122 into storage tank 130. Storage tank 130 can be any storage tank manufactured of a material, such as steel, for storage or transfer of LP gas. Storage tank 130 may also be a fuel tank of another vehicle. Storage tank 130 includes a valve 132 configured for transfer of LP gas. Evacuation system 110 is configured for attachment to valve 132 of storage tank 130 by way of hose 103.

Evacuation system 110 is powered by compressed air from air compressor 140. Air compressor 140 may include an air compressor configured to provide compressed air at, for example, pressures in the range of about 80-150 psi. Air compressor 140 includes a valve 142 for supplying the compressed air to evacuation system 110 via hose 104. In an embodiment, evacuation system 110 is further configured to alternatively provide LP gas removed from the vehicle tank 122 to burner 150. Burner 150 includes any burner configured to burn off LP gas vapor. Burner 150 connects to evacuation system 110 by way of hose 105.

Figure 2:
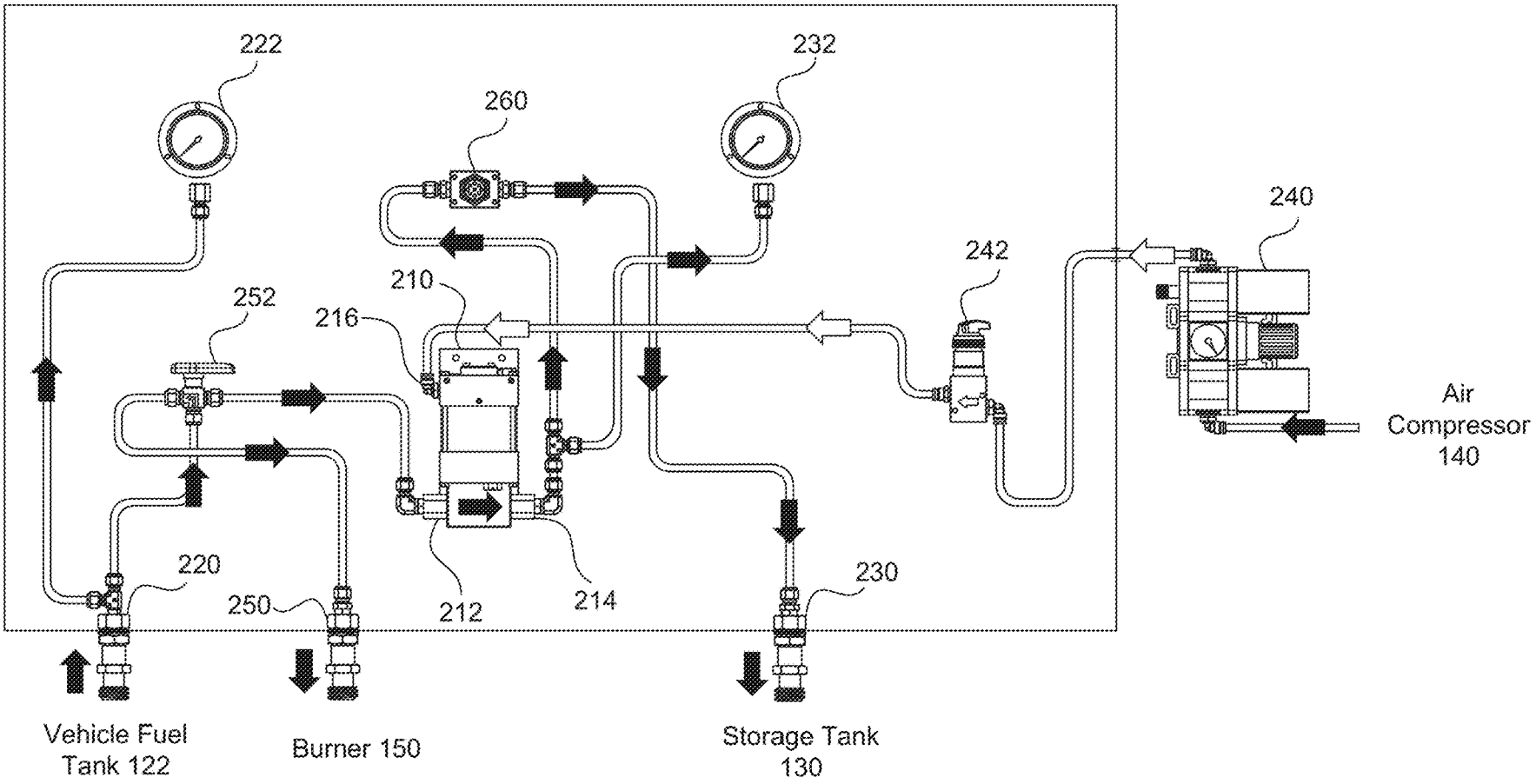
FIG. 2 is a schematic diagram illustrating select elements of the evacuation system, according to exemplary embodiments of the present disclosure.

FIG. 2 is a schematic diagram showing select elements of evacuation system 110 for purposes of illustrating functional elements and operation, according to exemplary embodiments of the present disclosure. Evacuation system 110 includes a pump 210 operable to pump both liquid and vapor phase LP gas from vehicle fuel tank 122 to storage tank 130. In one embodiment, pump 210 is a pneumatically driven displacement pump such as a piston-type pump. Pump 210 includes seals formed from a material substantially resistant to degradation by contact with LP gas, such as seals formed of polytetrafluoroethylene (PTFE). Pump 210 includes a chamber and pumping parts (not shown) that are preferably formed of materials such that no metal-on-metal contact occurs within a pumping chamber of the pump. For example, pump 210 can be manufactured such that PTFE covers surface areas of the chamber and/or pumping parts that contact each other. In an example of an embodiment of a piston-type pump, the inner surface of a cylinder, the outer surface of the piston, and/or the piston rings are coated with PTFE to prevent metal-on-metal contact. Eliminating metal-on-metal contact reduces the risk of the pump generating a spark that could cause a fire or explosion. As compared to electric motor driven pumps, the pneumatic driving mechanism of pump 210 eliminates the need to deliver electricity to the pump, further reducing fire and explosion risk. In an exemplary embodiment, pump 210 is a GB series (air drive, gas booster) pump manufactured by STK of Shenzen City, China, and available from http://www.sitec.cn/GBSeries/, that has been modified to replace all pump seals with PTFE seals. The GB series pumps are single-stage pumps that use a large reciprocating air drive piston coupled by a connecting rod to a smaller area piston. The large area piston is driven by compressed air and, in turn, drives the smaller area piston in a higher pressure gas barrel section.

Pump 210 includes a fuel suction port 212 to receive LP gas from vehicle fuel tank 122, and a fuel discharge port 214 to output the received LP gas to storage tank 130. Pump 210 also includes a compressed air port 216 for receiving compressed air from air compressor 140 for activating pump 210.

Evacuation system 110 includes an air pressure regulator 240 and a power or activation valve 242. Air pressure regulator 240 is configured to receive a supply of compressed air from air compressor 140 and to regulate the received compressed air to a desired output pressure (e.g., 40-110 psi) for activating pump 210. By regulating air pressure, air flow rate can be controlled, thereby controlling a pumping speed of pump 210. Activation valve 242 (e.g., a ball valve or gate valve) is coupled between air pressure regulator 240 and compressed air port 216 of pump 210. Activation valve 242 is configured to selectively provide the regulated compressed air to pump 210 for activating the pneumatic engine of pump 210 to provide an on/off functionality of pump 210.

Evacuation system 110 includes a vehicle tank connector 220 and a storage tank connector 230. Vehicle tank connector 220 and storage tank connector 230 are configured to be coupled to hoses 102, 103, respectively. During a fuel tank evacuation procedure, vehicle tank connector 220 facilitates LP gas entering evacuation system 110 to flow to pump 210, and storage tank connector 230 facilitates LP gas exiting evacuation system 110 to flow to storage tank 130. Vehicle tank connector 220 and storage tank connector 230 are formed from a material substantially resistant to degradation by contact with the LP gas such as brass.

Once an LP gas is received at vehicle tank connector 220, the LP gas flows to both fuel suction port 212 of pump 210 and a pressure gauge 222. Pressure gauge 222 is configured to display a pressure of the LP gas received at evacuation system 110 (i.e., the vapor pressure on fuel tank 122). The LP gas exiting pump 210 flows to both storage tank connector 230 and another pressure gauge 232. Pressure gauge 232 is configured to display an LP gas pressure exiting evacuation system 110 (i.e., the vapor pressure on storage tank 130).

In an embodiment, evacuation system 110 also includes a burner connector 250 and a storage/burner valve 252. Burner connector 250 facilitates connection between evacuation system 110 and burner 150. Burner connector 250 is formed from a material substantially resistant to degradation by contact with the LP gas, such as those described above for other connectors. A storage/burner valve 252 is coupled between vehicle tank connector 220, pump 210, and burner connector 250. Storage/burner valve 252 is configured to selectively direct the flow of received LP gas such that LP gas flows from vehicle storage tank 122 to one of storage tank 130 (via pump 210) or burner 150. Examples of storage/burner valve 252 include a ball valve or gate value formed from materials resistant to degradation by LP gas, such as those described above.

In an embodiment, evacuation system 110 further includes a sight glass 260. Sight glass 260 is positioned between pump 210 and storage tank 130 and is configured to permit visual inspection of LP gas being transferred from vehicle fuel tank 122 to storage tank 130.

The elements of evacuation system 110 shown in FIG. 2 are interconnected by connection tubes as shown. The connection tubes connecting air pressure regulator 240, activation valve 242, and pump 210 can be any hose, pipe, or other conduit formed from any material suitable for use with air at working pressures of 150 psi, for example. These connection tubes can be formed, for example, from copper, steel, rubber, or certain polymer materials. Flexible tubing or hoses, however, may be preferred for ease of assembly in some applications. The connection tubes connecting the other elements shown in FIG. 2 will be in contact with LP gas and must therefore be formed from materials (e.g., metals such as copper, brass or steel; or some plastics such as polyethylene or nitrile) that are substantially resistant to degradation by contact with LP gas. They must also have sufficient structural integrity to withstand the vapor pressures found in a vehicle propane tank (e.g., 300 psi). Additionally, the connection tubes connecting vehicle fuel tank connector 220 to pump 210 should have sufficient structural integrity to withstand a vacuum pressure of zero PSI exerted by pump 210 (relative to atmospheric pressure where system 110 is being used (e.g., 14.7 PSI)). In an exemplary embodiment, all connection tubes in system 110 are formed from stainless steel tubing having 0.375 inch outer diameter. In this embodiment, stainless steel compression fittings may be used to complete all connections, as would be understood by those skilled in the art.

Figure 3:
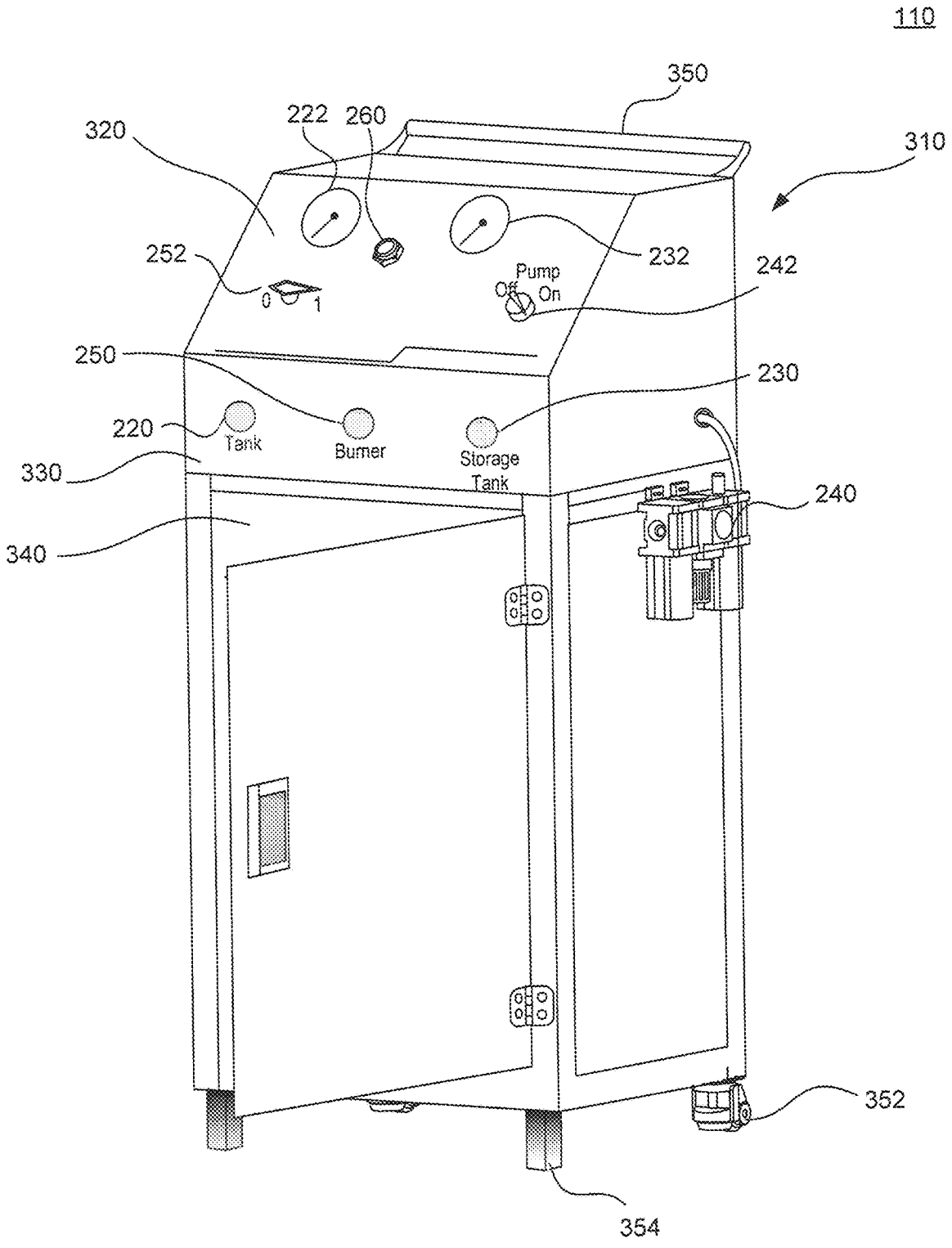
FIG. 3 illustrates a perspective view of the evacuation system including a portable housing structure configured for use in a vehicle repair or maintenance shop, according to exemplary embodiments of the present disclosure.

FIG. 3 is a perspective view of evacuation system 110 including a portable housing (e.g., a body, chassis, frame or enclosure) 310 configured for use in a vehicle repair or maintenance shop, according to exemplary embodiments of the present disclosure. Housing 310 is configured for housing in or mounting thereon the other components of evacuation system 110. Housing 310 is manufactured of a material, such as sheet metal or aluminum, to support the weight of the different components of evacuation system 110 and to provide structural integrity and portability for system 110. Housing 310 includes a control panel 320, a connection panel 330, a storage area 340, a handle 350, wheels 352, and legs 354.

Control panel 320 is formed on, or mounted to, an upper area of housing 310 to provide a convenient location, both for visibility and accessibility, for the mounting of pressure gauges 222, 232, activation valve 242, storage/burner valve 252, and sight glass 260. Connection panel 330 is an area of housing 310 that supports vehicle tank connector 220, storage tank connector 230, and, in an embodiment, burner connector 250. In an exemplary embodiment, connectors 220, 230 and 250 are bulkhead-type thru-fittings mounted to connection panel 330. Tubes 102, 103, and 105 (shown in FIG. 1) include connectors/couplers configured to mate with connectors 220, 230, and 250 at or near connection panel 330.

Storage area 340 is formed in the interior of housing 310 and is sized and configured to receive mounting of pump 210 (not shown in FIG. 3) therein and to receive air pressure regulator 240 mounted thereon. Storage area 340 is also configured to contain the tubing and connections shown in FIG. 2 that interconnect the elements of evacuation system 110. In an embodiment, storage area 340 may also be used to store hoses 102-105 when they are not in use.

Housing 310 also includes a handle 350 and wheels 352 to facilitate portability of evacuation system 110 within a garage or shop as well as into a truck or van for transport. Housing 310 also includes support legs 354. In an alternate embodiment, wheels 352 can be omitted, and a leg 354 can be mounted at each corner of housing 310. In another alternative embodiment, legs 354 can be omitted, and a wheel 352 can be mounted at each corner of housing 310.

It will be apparent to those skilled in the relevant art that control panel 320, connection panel 330, storage area 340, and supported components may be configured, arranged, and located differently than shown by FIG. 3.

In operation, a user connects evacuation system 110 to vehicle fuel tank 122, storage tank 130, and air compressor 140, by way of respective hoses 102-105. Next, air compressor 140 is powered on to provide compressed air to evacuation system 110. Air pressure regulator 240 is then adjusted for a desired pressure to power evacuation system 110. The desired pressure is selected to be less than a maximum flow rate of excess flow valve 124 of vehicle 120, such that pump 210 removes an LP gas from vehicle fuel tank 122 at a rate below the maximum flow rate. When evacuation system 110 is prepared, as described above, pump 210 can then be turned on by opening activation valve 242 to provide a supply of compressed air to drive/activate a pneumatic engine of pump 210. Once activated, pump 210 pulls LP gas from the bottom of vehicle fuel tank 122 and pushes the LP gas into storage tank 130. During operation, a user has the ability to monitor the pressure of LP gas entering and exiting evacuation system 110 by way of pressure gauges 222, 232. In an embodiment, the user can also view LP gas being transferred to storage tank 130 by way of sight glass 260.

In an embodiment, the evacuation system 110 can also be used to refill the vehicle fuel tank 122. To refill the vehicle fuel tank 122, hose 102 is connected to storage tank 130, and hose 103 is connected to vehicle fuel tank 122, while the pump 210 is turned off. In this configuration, the storage tank 130 is arranged as a source tank and the vehicle fuel tank 122 is arranged as a storage tank such that when activated, by way of the activation valve 242, pump 210 removes LP gas from the storage tank 130 and pushes the LP gas into the vehicle fuel tank 122.

Because pump 210 can be adjusted (using pressure regulator 240) to pump at a selected rate below the maximum fuel rate of excess flow valve 124, the temperature of pump 210 can be controlled and prevented from generating excess heat which can cause the liquid phase LP gas to convert to vapor at a pressure at which it would otherwise be a liquid. In other words, a working temperature of the pump 210 is substantially similar to a rest temperature (e.g., within about 10 degrees Fahrenheit) of the pump 210. However, as pressure in vehicle fuel tank 122 drops due to the removal of the liquid phase LP gas, the change in pressure will eventually cause the remaining LP gas vaporize. As this happens, pump 210 begins a transition phase in which liquid and vapor are removed from vehicle fuel tank 122. For example, during this phase a user (via sight glass 260) can view LP gas boiling while being transferred to storage tank 130. Pump 210 continues to remove gas phase LP gas from vehicle fuel tank 122 until all LP gas has been removed and a vacuum is reached. At which point activation valve 242 can be closed, which stops pump 210 from pumping. Unlike traditional pumps (e.g., turbine-type and gear pumps) used in the transfer of liquid phase LP gas, pump 210 efficiently and effective removes both liquid-phase LP gas and gas phase LP gas, and does so with minimal risk of fire or explosion. Such a system and method have not been available in the prior art.

CONCLUSION

It is to be appreciated that the Detailed Description section, and not the Abstract section, is intended to be used to interpret the claims. The Abstract section may set forth one or more, but not all exemplary embodiments, and thus, is not intended to limit the disclosure and the appended claims in any way.

The disclosure has been described above with the aid of functional building blocks illustrating the implementation of specified functions and relationships thereof. The boundaries of these functional building blocks have been arbitrarily defined herein for the convenience of the description. Alternate boundaries may be defined so long as the specified functions and relationships thereof are appropriately performed.

It will be apparent to those skilled in the relevant art(s) that various changes in form and detail can be made therein without departing from the spirit and scope of the disclosure. Thus, the disclosure should not be limited by any of the above-described exemplary embodiments, but should be defined only in accordance with the following claims and their equivalents.

What is claimed is:

1. A system for transferring LP gas from a first tank to a second tank, comprising:

an inlet port configured for connection to a single connection port of the first tank, the inlet port configured to receive liquid phase LP gas, vapor phase LP gas, and a combination of both from the first tank;

an outlet port configured for connection to a single connection port of the second tank, the outlet port configured to deliver the liquid phase LP gas, vapor phase LP gas, and combination of both to the second tank;

a pump coupled between the inlet port via a first conduit and the outlet port via a second conduit, wherein the pump is operable to pump the liquid phase LP gas, vapor phase LP gas, and a combination of both from the first tank via the inlet port to the second tank via the outlet port through the first and second conduits and a valve connected in series with the inlet port, the outlet port, and the pump, and configured to close at a predetermined flow rate.

2. The system for transferring LP gas of claim 1, wherein the pump is configured to pump the LP gas from the first tank at a rate that is less than or equal to 2.0 gallons per minute.

3. The system for transferring LP gas of claim 2, wherein the pump is configured to pump the LP gas from the first tank at a rate in the range of 1.4 to 2.0 gallons per minute.

4. The system for transferring LP gas of claim 1, wherein the pump is a displacement pump.

5. The system for transferring LP gas of claim 4, wherein the pump is a pneumatically driven displacement pump.

6. The system for transferring LP gas of claim 1, wherein the pump is configured to pull liquid LP gas from the first tank during a liquid phase and to pull vapor LP gas from the first tank during a transition phase.

7. The system for transferring LP gas of claim 1, wherein the first tank is a vehicle fuel tank.

8. The system for transferring LP gas of claim 1, wherein the second tank is a vehicle fuel tank.

9. The system for transferring LP gas of claim 1, wherein the first tank is a first vehicle fuel tank and the second tank is a second vehicle fuel tank.

10. A LP gas evacuation system for evacuating both liquid phase and vapor phase LP gas from a first tank, comprising:

an inlet port configured for connection to an excess flow valve associated with the first tank to receive LP gas from the first tank;

an outlet port configured for connection to a second tank;

a pump coupled between the inlet port and the outlet port and operable to pump the LP gas from the first tank via the inlet port to the second tank via the outlet port, wherein the pump is a pneumatically driven displacement pump operable to pump both liquid phase and vapor phase LP gas; and a pneumatic pressure regulator configured and arranged to receive a supply of compressed air and to provide the compressed air to the pump at a specified pressure.

11. The LP gas evacuation system of claim 10, wherein the second tank is a vehicle fuel tank.

12. The LP gas evacuation system of claim 10, wherein the pump is configured to pump the LP gas from the first tank at a rate that is below a maximum flow rate of the excess flow valve.

13. The LP gas evacuation system of claim 10, wherein the pump is a piston-type pump.

14. The LP gas evacuation system of claim 10, wherein the pump is configured to pump liquid LP gas from the first tank during a liquid phase and to pump vapor LP gas from the first tank during a transition phase.

15. The LP gas evacuation system of claim 10, wherein the pump is configured to pump the LP gas from a bottom of the first tank.

16. A method for transferring LP gas from a first tank to a second tank, the method comprising:

providing a pump operable to pump both liquid phase and vapor phase LP gas, the pump having a suction port configured to be connected to the first tank and a discharge port configured to be connected to the second tank;

connecting the suction port of the pump to the first tank via a first conduit;

connecting the discharge port of the pump to the second tank via a second conduit;

connecting a valve in series with the pump, the first conduit, and the second conduit;

powering the pump to transfer both the liquid phase and vapor phase LP gas from the first tank to the second tank at or below a flow rate of 2.0 gallons per minute; and closing the valve when the flow rate exceeds 2.0 gallons per minute.

17. The method of claim 16, wherein the flow rate is in the range of 1.4 to 2.0 gallons per minute.

* * * * *